United States Patent [19]

Kaira

[11] 3,987,922

[45] Oct. 26, 1976

[54] PACKAGING TRAY FOR FRUIT

[75] Inventor: Lauri Olavi Kaira, Kuusankoski, Finland

[73] Assignee: Kymin Osakeyhtio-Kymmene Aktiebolag, Kuusankoski, Finland

[22] Filed: Nov. 6, 1974

[21] Appl. No.: 521,446

[30] Foreign Application Priority Data

Nov. 16, 1973 Finland ..... 3555/73

[52] U.S. Cl. ..... 217/26.5; 229/2.5 R

[51] Int. Cl.[2] ..... B65D 85/34

[58] Field of Search ..... 217/26.5, 26; 229/2.5; 220/339

[56] References Cited

UNITED STATES PATENTS

| | | | |
|---|---|---|---|
| 1,255,789 | 2/1918 | Pruyn | 217/26.5 |
| 3,040,923 | 6/1962 | Leitzel | 217/26.5 |
| 3,289,877 | 12/1966 | Wolf | 220/339 |
| 3,333,760 | 8/1967 | Bridenstine | 229/2.5 |
| 3,357,624 | 12/1967 | Crabtree | 217/26.5 |
| 3,417,897 | 12/1968 | Johnson | 220/339 |
| 3,732,976 | 5/1973 | Bessett et al. | 217/26.5 |

*Primary Examiner*—George E. Lowrance
*Assistant Examiner*—Allan N. Shoap
*Attorney, Agent, or Firm*—Cushman, Darby & Cushman

[57] ABSTRACT

The invention relates to a packaging tray for fruit of the type comprising a plurality of calotte-shaped depressions for fruit arranged in parallel rows and supporting areas between the depressions. The depressions and supporting areas in different trays are arranged such that a depression of an upper tray coincides with a supporting area of the next lower tray in a stack of trays, and the supporting areas are situated at a higher level than the lowermost points of the depressions of the same tray but still at a sufficiently low level to touch the uppermost points of the fruit supported on the next lower tray. The supporting areas have central portions forming downwardly convex surfaces in all vertical cross-sections, and the proportion between the rigidity of the material of the packaging tray and the radius of curvature of the central portions of the supporting areas is selected such that the central portions yield by buckling under the forces normally appearing in placing a tray loaded with fruit in a transport box.

3 Claims, 7 Drawing Figures

A-A

B-B

C-C

D-D

PACKAGING TRAY FOR FRUIT

BACKGROUND OF THE INVENTION

1. Field of the Invention

The present invention relates to a packaging tray to be used when packing fruit or other easily bruised objects of slightly varying size in several layers in a box so that the packaging tray of an upper layer rests on the fruit of the layer below, and the material used for the structure is fiber pulp or plastic in a substantially single layer.

Such a packaging tray for fruit has almost calotte-shaped depressions for fruit, and these depressions are placed in rows, each row having several depressions. The number of depressions depends on their size and thereby on the size of the fruit to be packed.

When packing fruit, two kinds of packaging trays are used alternately in different layers to the effect that a fruit of a lower layer always coincides with an intermediate space between the fruit of the upper layer.

2. Description of the Prior Art

Generally used is a packaging tray for fruit which rests on the fruit of a lower layer so that each fruit is touched by the lower surfaces of the closest fruit depressions of the upper packaging tray, that is, the fruit is wedged between the depressions. Such wedging would not be so damaging if the fruit were of equal size and preferably spherical, in which case there would be a great number of contact points. In practice, however, owing to the non-spherical and varying shape of fruit, there are few contact points and these receive excessive surface pressure.

In order to eliminate the problems due to the non-spherical shape of fruit, a structure is used in which there is a plane surface in the area between the fruit depressions and at such a height that its lower surface rests against the highest point of a fruit of the lower level. Such a solution is described in U.S. Pat. No. 3,040,923.

Also known is a construction in which there is a slightly downward concave supporting surface in the supporting area between two depressions, and this supporting surface is at such a height that it rests against the highest point of the fruit of the lower level and allows for a slightly non-spherical shape. Such a downward concave supporting surface may also be partial, as suggested in U.S. Pat. No. 3,281,003.

Previously known packaging trays for fruit do not yield sufficiently and therefore, when used, rest on a few large fruit, thereby bruising their sensitive surface.

SUMMARY OF THE INVENTION

A packaging tray for fruit according to the invention, the characteristics of which are given in the patent claims, rests on the fruit of the lower layer more gently than known constructions. Its gentle contact and its applicability to different kinds of fruit are based on the fact that the downward convex surface of the supporting area, which touches some point of the fruit apically, yields by buckling and cannot press a small area of the fruit with a very great force. When the packaging tray is used, the said supporting areas yield by buckling until the load is distributed between a sufficient number of fruit of the lower layer. In addition to the advantageous distribution of the load, it is advantageous that a downward concave supporting surface is created by buckling at the right point and in the right position in the downward convex surface of the supporting area.

What makes the packaging tray according to the invention novel and far superior to the previously known ones is that the supporting areas have downward convex surfaces which touch the fruit of the lower level and these supporting areas yield softly as cushions at the right points and to the right extent, which protects the sensitive surfaces of fruit surprisingly well.

A packaging tray for fruit according to the invention is also advantageous to manufacture since the requisite mold has a simple shape.

SHORT DESCRIPTION OF THE DRAWING

DESCRIPTION OF THE PREFERRED EMBODIMENT

Figure 1:
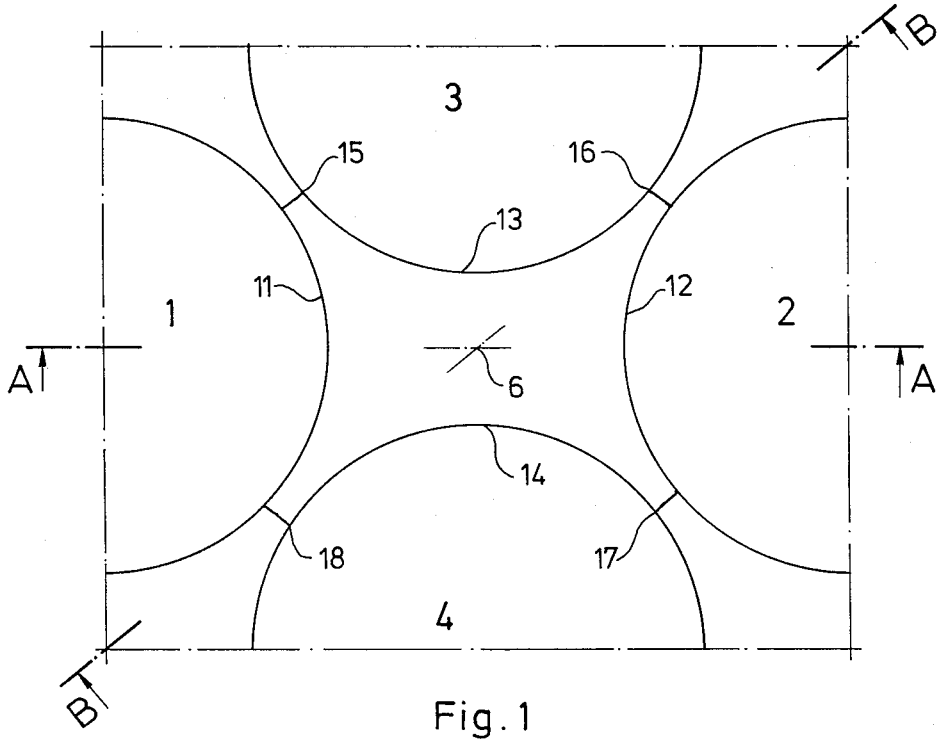
FIG. 1 shows a plane view of a part of a packaging tray for fruit according to the invention; it shows four depressions for fruit and the downward convex supporting area left between them.

Since a packaging tray for fruit according to the invention consists of several similar depressions for fruit, situated in rows, and of similar intermediate spaces left between the depressions, the figures show only partial pictures of packaging trays according to the invention, clearly illustrating the characteristics of the invention.

The packaging tray for fruit according to the invention and illustrated in the figures have almost calotte-shaped depressions for fruit. Depressions 1, 2 (FIGS. 1 and 2) and 21, 22 (FIGS. 4 and 5) constitute a row of their own parallel to the side of the packaging tray, and depressions 3, 4 (FIGS. 1 and 2) and 23, 24 (FIGS. 4, and 5) belong to the adjacent rows and are staggered in relation to the former ones. Between the fruit depressions there remains a supporting area 5 (FIGS. 1 and 2) and 25 (FIGS. 4 and 5), where the material 19 of a substantially even thickness (FIGS. 2 and 3) and 29 (FIGS. 5 and 6) forms a downward convex spherical surface 7 (FIGS. 2 and 3) and 27 (FIGS. 5 and 6), the center point 6 (FIGS. 2 and 3) and 26 (FIGS. 5 and 6) being the lowest. The radius of curvature of the spherical surface 7, 27 is greater than the radius of the fruit to be packed. The lowest point 6, 26 of the supporting area 5, 25 is at such a height that, when the packaging tray is lowered onto the fruit of the lower layer, it touches the fruit before the lower surfaces 8, 9, 10 (FIGS. 2 and 3) and 28, 29, 30 (FIGS. 5 and 6) of the fruit depressions do.

Figure 2:
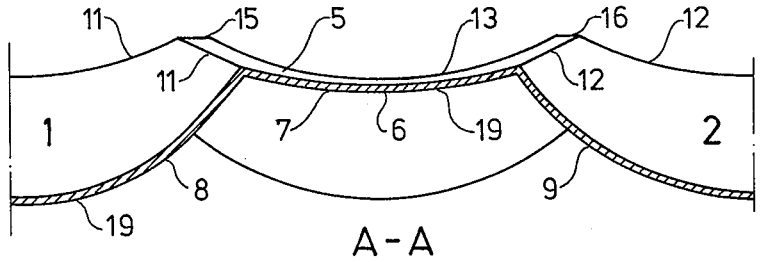
FIGS. 2 and 3 show two sections of the packaging tray shown in FIG. 1.
Figure 3:
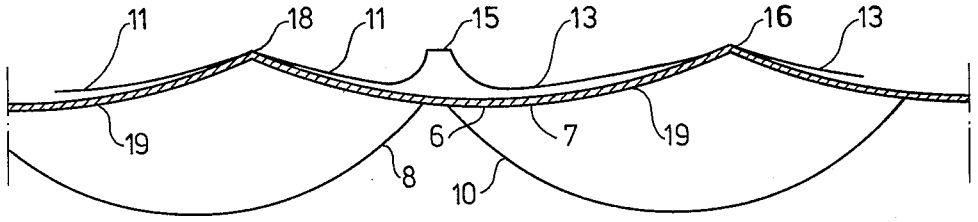
Figure 4:
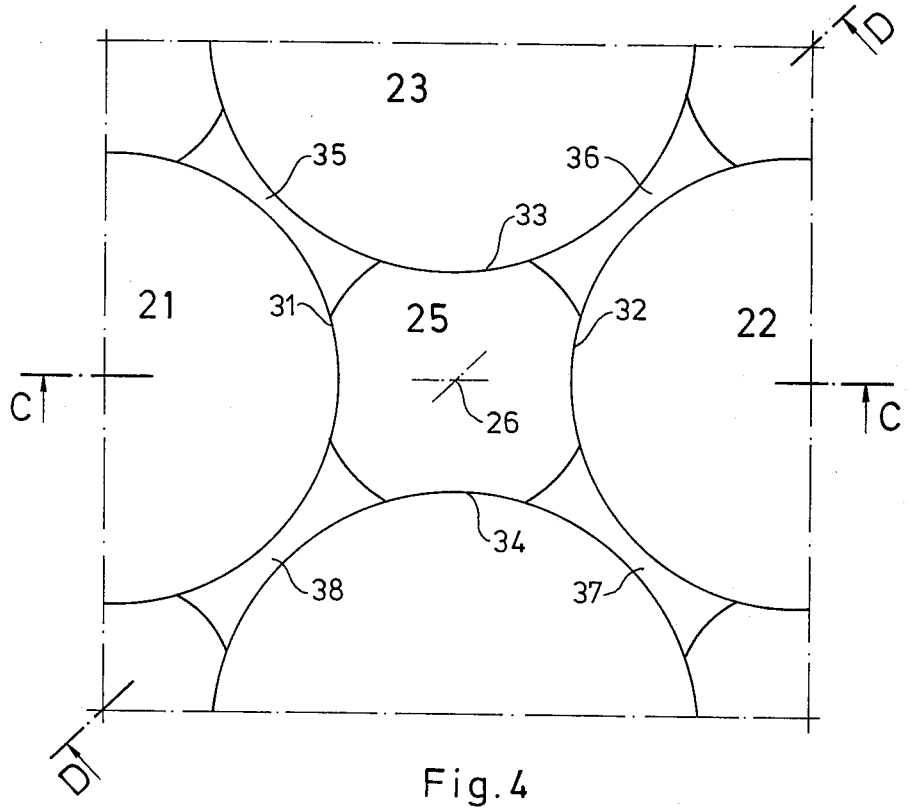
FIG. 4 shows a plane view of a part of another packaging tray for fruit according to the invention.
Figure 5:
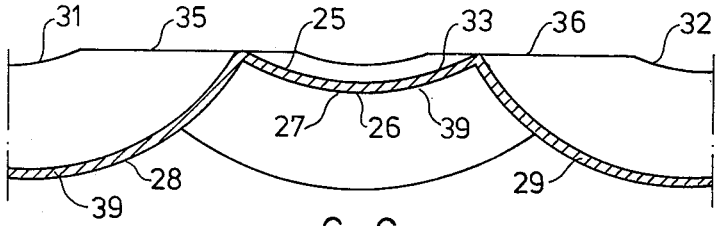
FIGS. 5 and 6 show two sections of the packaging tray part shown in FIG. 4.
Figure 6:
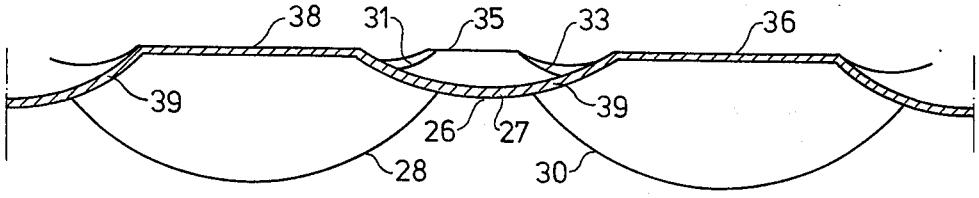

In the embodiment shown in FIGS. 1 to 3, the spherical surface of the supporting area 5 rises highest at the center points 15, 16, 17, 18 of the ridges between the fruit depressions. At these points the spherical surface meets the respective spherical surfaces of the adjacent supporting areas. In the embodiment shown in FIGS. 4 to 6 the spherical surface rises towards the horizontal plane areas 35, 36, 37, 38 on the ridges between the fruit depressions; these plane areas also meet the spherical surfaces of the adjacent supporting areas. The fruit depressions 1, 2, 3, 4 (FIGS. 1 and 2) and 21, 22, 23, 24 (FIGS. 4 to 6) adjoin the spherical surfaces of the supporting areas 5, 25 along lines 11, 12, 13, 14 (FIGS. 1 to 3) and 31, 32, 33, 34 (FIGS. 4 to 6).

The shapes of the supporting areas of a packaging tray according to the invention can be downward convex spherical surfaces as in the embodiments illustrated, or other downward convex shaped surfaces of revolution or other surfaces convex in all their vertical cross sections and which, owing to the convexity of their central area yield by buckling when loaded and form, after buckling, downward concave supporting surfaces which almost follow the shapes of the fruit. The stiffness of the material and the radius of curvature of the supporting area are selected so that the weakest force under which the supporting area yields by buckling is less than 10 N. The thickness of the material of the packaging tray can then be substantially equal all over, as in the embodiments illustrated, or the central parts of the supporting areas can be thinner and thereby less stiff than the other parts of the packaging tray. The rigidity of the central parts of the supporting areas of an evenly thick packaging tray can also be less than that of the other parts of the packaging tray because they have perforations or cuts.

In the supporting areas 5, 25 of a packaging tray for fruit according to the invention, some parts of the edge area which are close to the boundary lines 11, 12, 13, 14, 31, 32, 33, 34 of the depressions for fruit can deviate from the otherwise uniform shape of the supporting area and extend considerably higher than the other parts or to the same height as the highest points (15, 35) situated on the ridges between the fruit depressions (1, 2, 21, 22).

Figure 7:
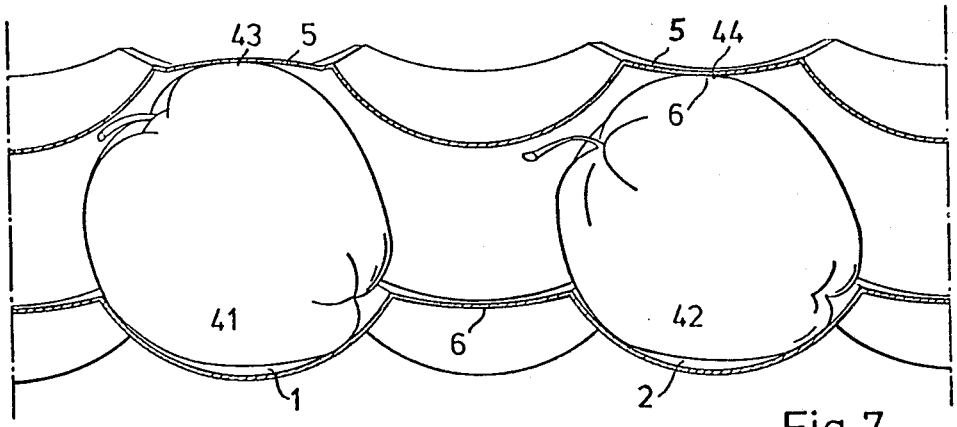
FIG. 7 is a pictorial illustration in partial section of a pair of the packing trays illustrated in FIGS. 1–3 with fruit positioned therebetween.

FIG. 7 shows two trays according to the embodiment shown in FIGS. 1–3 placed on top of each other and having fruits 41 and 42 inserted in fruit depressions 1 and 2 respectively of the lower tray. Fruit 42 is of such a size that the lowermost point 6 of the support area 5 of the upper tray just touches the top portion 44 of fruit 42 without deforming. Fruit 41 is so much larger that its top portion 43 forces the corresponding support area 5 to yield from its normal downwardly convex shape to an upwardly convex shape, as indicated.

What is claimed is:

1. A packaging tray for fruit for packing fruit supported on such trays in a transport box in several layers on top of each other, comprising a molded material layer having a plurality of substantially calotte-shaped depressions for fruit arranged in parallel rows, and supporting areas between said depressions, said depressions and supporting areas being arranged such that a depression of an upper tray coincides with a supporting area of the next lower tray, said supporting areas being situated at a higher level than the lowermost points of said depressions of the same packaging tray but still at a sufficiently low level to touch the uppermost points of the fruit supported on the next lower tray, said supporting areas having central portions forming downwardly convex surfaces in all vertical cross-sections, said central portions having a radius of curvature larger than the average radius of curvature of said fruit to be packed and a thickness selected in relation to the rigidity of the material of said tray and to said radius of curvature to render said central portions yieldable from said downwardly convex shape in unloaded condition to a downwardly concave shape conforming substantially to the upper surface of said fruit, under the forces appearing in placing a tray loaded with fruit in a transport box.

2. A packaging tray as in claim 1, the proportion between the rigidity of the material of said packaging tray and the radius of curvature of said central portions of said supporting surfaces being selected such that the smallest force under which said central portions yield by buckling is less than 10 N.

3. A packaging tray as in claim 1, the highest points of said packaging tray being situated in the areas between two adjacent depressions.

* * * * *